United States Patent [19]

Crawford et al.

[11] 4,082,497

[45] Apr. 4, 1978

[54] HIGH CAPACITY QUIET BURNER FOR HOT AIR HEATING SYSTEM

[75] Inventors: Duncan J. Crawford, Franklin; Gonzalo D. Santiago, Union Lake, both of Mich.

[73] Assignee: Ex-Cell-O Corporation, Troy, Mich.

[21] Appl. No.: 671,685

[22] Filed: Mar. 29, 1976

[51] Int. Cl.[2] ..... F23D 15/00

[52] U.S. Cl. ..... 431/158; 431/346; 431/351; 432/222

[58] Field of Search ..... 431/13, 19, 158, 346, 431/351, 352, 182–184, 187, 188, 329; 432/222

[56] References Cited

U.S. PATENT DOCUMENTS

| | | | |
|---|---|---|---|
| 1,047,392 | 12/1912 | Deemar | 431/352 |
| 1,304,402 | 5/1919 | Spire | 431/188 |
| 1,958,913 | 5/1934 | De Coriolis et al. | 431/19 |
| 2,106,414 | 1/1938 | Price | 431/19 |
| 2,107,365 | 2/1938 | Bray | 431/351 |
| 2,269,333 | 1/1942 | Bloom | 431/188 |
| 3,185,458 | 5/1965 | Reed | 432/222 |
| 3,195,606 | 7/1965 | Stout | 431/19 |
| 3,418,060 | 12/1968 | Spielman et al. | 431/158 |
| 3,527,027 | 9/1970 | Knight et al. | 55/527 |
| 3,561,896 | 2/1971 | Riehl | 431/354 |
| 3,695,817 | 10/1972 | Sharan | 431/182 |
| 3,779,694 | 12/1973 | Zagoroff | 431/352 |
| 3,857,670 | 12/1974 | Karlovetz et al. | 431/329 |
| 3,917,442 | 11/1975 | Zagoroff | 431/351 |
| 3,986,817 | 10/1976 | Lambiris | 432/222 |

*Primary Examiner*—Carroll B. Dority, Jr.
*Attorney, Agent, or Firm*—Robert G. Mentag

[57] ABSTRACT

A high capacity, quiet burner for a hot air heating system for use in heating the top and bottom ends of a plastic coated carton, or the like, and which has a tubular burner body provided with a chamber therein which is open at an outlet end and enclosed at an inlet end. A burner nozzle is mounted in the burner body chamber adjacent the inlet end, and a mixture of primary air and fuel is conveyed into the burner nozzle and ignited by a spark plug. Secondary air under pressure is conveyed into the burner body chamber, for flow around the burner nozzle for heating the secondary air and for mixing the secondary air with combustion gases formed by the combustion of the mixture of primary air and fuel in the burner nozzle, and for subsequent discharge through the outlet end of the burner body chamber onto a carton end to be heated. The burner nozzle is provided with a screen pack for dividing the primary air and gas mixture into fine segments, and with a fiberglass filter means for reducing fluid flow noises. A perforated plate is also provided in the burner nozzle, and it co-acts with the screen pack for further reducing the noise level during the combustion process, as well as aiding in a uniform and stable combustion.

18 Claims, 2 Drawing Figures

HIGH CAPACITY QUIET BURNER FOR HOT AIR HEATING SYSTEM

SUMMARY OF THE INVENTION

This invention relates generally to combustion apparatus, and more particularly, to a novel and improved combustion apparatus for use as a high-capacity quiet hot air burner for supplying hot air to heat the top and bottom ends of cartons in a carton packaging machine.

Heretofore, hot air heaters have been provided for heating top and bottom ends of cartons while being processed in a packaging machine. However, some prior art hot air heaters have disadvantages in that they produced carbon monoxide gases which passed out into the room where the packaging machine was being used. Some other prior art machines have the disadvantage in that they were noisy and exceeded the noise limits of the federal and state laws concerning the same. The former disadvantage was caused by the fact that some prior art hot air heaters brought the gas and air directly into a burner without any prior mixing, and an excess amount of gas was used in order to get the desired temperature, and the gases were not being burned off entirely, whereby carbon monoxide gases were produced which passed out into the room where the packaging machine was being used. The latter prior art devices were run at high air pressures in order to obtain the high B.T.U. output desired and this action resulted in increased fluid flow velocity and a blow torch type noise at the point of burning.

In view of the foregoing, it is the primary object of the present invention to provide a novel and improved high capacity quiet burner for a hot air heating system for a carton packaging machine which overcomes the aforementioned disadvantages of the prior art burners used in such packaging machines.

It is another object of the present invention to provide an improved high capacity quiet burner for a hot air heating system for a carton packaging machine which controls the mixture of primary air and gas to provide quiet and efficient combustion to eliminate injurious carbon monoxide gases, and wherein the fluid flow velocity is controlled to reduce fluid flow noises.

It is still another object of the present invention to provide an improved high capacity quiet burner for a hot air heating system for a carton packaging machine which employs a supply of primary air for mixture with gas for combustion purposes, which in turn heats a supply of secondary air to provide a simple and compact burner of this type which is economical to manufacture, and which is efficient and quiet in operation.

It is still another object of the present invention to provide a novel and improved high capacity quiet burner for a hot air heating system for a carton packaging machine which is constructed and arranged so as to provide a low fluid flow velocity of a mixture of primary air and gas at the point of burning to eliminate high fluid flow velocity and burning noises at that point in the combustion process.

It is a further object of the present invention to provide a novel and improved high capacity burner for a hot air heating system for a carton packaging machine which employs a burner nozzle means which includes a screen pack and at least one perforated plate for dividing the primary air and gas mixture prior to ignition, so as to provide mixing and turbulent fluid flow of the primary air and gas mixture at the point of burning, and which burner nozzle means may be further provided with a fiberglass filter means for reducing fluid flow noises created by the high capacity flow of the primary air and gas mixture into the burner nozzle means.

It is a further object of the present invention to provide a novel and improved high capacity quiet burner for a hot air heating system for a carton packaging machine which has a tubular burner body provided with a chamber therein which is open at an outlet end and enclosed at an inlet end. A burner nozzle is mounted in the burner body chamber adjacent the inlet end and a mixture of primary air and fuel is conveyed into the burner nozzle and ignited by a spark plug. Secondary air under pressure is conveyed into the burner body chamber for flow around the burner nozzle for heating the secondary air and for mixing the secondary air with combustion gases formed by the combustion of the mixture of primary air and fuel in the burner nozzle, and for subsequent discharge through the outlet end of the burner body chamber onto a carton end to be heated. The burner nozzle is provided with a screen pack for dividing the primary air and gas mixture into fine segments and a fiberglass filter means for reducing fluid flow noises. At least one perforated plate is also provided in the burner nozzle and it coacts with the screen pack for further reducing the noise level during the combustion process, as well as aiding in uniform and stable combustion.

Other objects, features and advantages of this invention will be apparent from the following detailed description, appended claims, and the accompanying drawings.

DETAILED DESCRIPTION OF THE PREFERRED EMBODIMENTS

Figure 1:
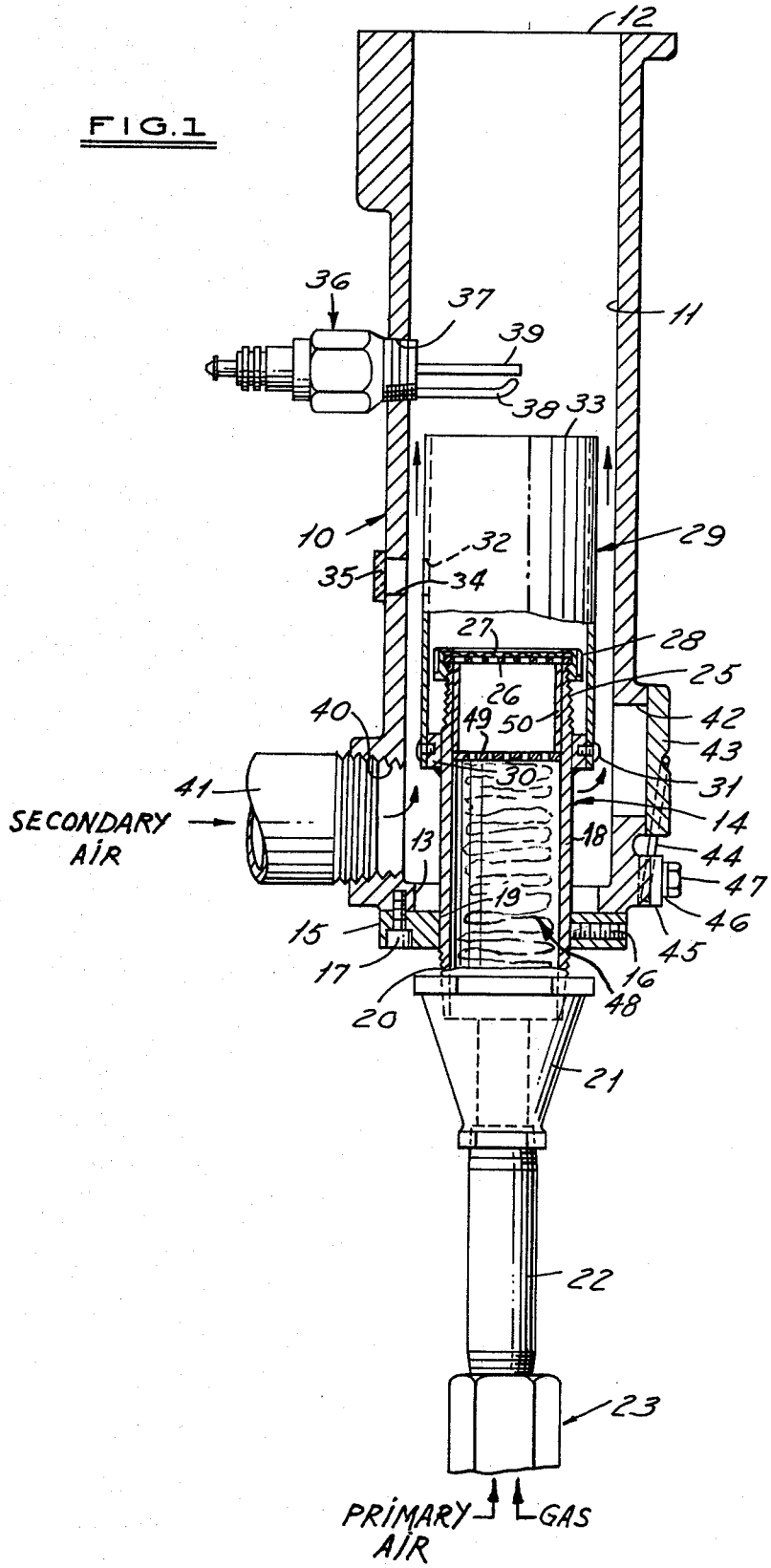
FIG. 1 is an elevational view, with parts in section and parts broken away, of a first embodiment of a high capacity quiet burner for a hot air eating system.

Referring now to the drawings, and in particular to FIG. 1, the numeral 10 generally designates the body or outer housing of a first illustrative embodiment of a high capacity quiet burner for a hot air heating system made in accordance with the principles of the present invention. The burner body 10 is elongated and cylindrical in overall configuration, and it includes an inner elongated cylindrical chamber 11, which is open at the discharge or outlet end 12 thereof. The body chamber 11 also communicates at its inner end with the open inlet end 13 of the body 10.

A burner nozzle, generally indicated by the numeral 14, is operatively mounted in the body chamber 11, at the inlet end thereof. The burner chamber inlet end 13 is enclosed by a mounting plate 15, which is secured to the burner body 10 by any suitable means, as by a plurality of suitable machine screws 17. The nozzle 14 comprises an elongated cylindrical body 18 which has its inner end extended into the burner chamber 11 and the lower end thereof slidably mounted in an axial bore 19 formed through the mounting plate 15.

The nozzle body 18 is secured in place in the mounting plate 15 by a suitable set or lock screw 16. The lower end of the nozzle body 18 extends outwardly of the mounting plate 15, and it is threaded, as indicated by the numeral 20. The larger end of a pipe reducer 21 is threadably mounted on the threaded end 20 of the nozzle body 18. A pipe or conduit means 22 has one end threadably mounted in the smaller end of the pipe reducer 21. The other end of the pipe 22 is threadably connected to a conventional primary air and fuel mixer, generally indicated by the numeral 23.

As shown in FIG. 1, a perforated grid or burner plate 26 is seated over the discharge or outlet end of the nozzle body 18. A screen pack 27 is seated on the outer face of the perforated grid or burner plate 26. The screen pack 27 comprises one or more layers of screen material made from any suitable heat resistant metal. For optimum operation, the screen pack 27 should be made from screen that is not coarser than a thirty mesh screen and not finer than a forty mesh screen. The chamber inside of the nozzle body 18 is preferably filled with a fiberglass packing 48 which may comprise any suitable packing of the type, as for example, fiberglass insulation wool used in insulating buildings. A cylindrical retainer sleeve 50 is located within the upper end of nozzle body 18 setting on perforated baffle plate 49. The baffle plate 49 rests atop the wool packing 48 with both the sleeve 50 and baffle plate 49 under the sleeve held in place by the sleeve 50 engaging the perforated burner plate 26.

The perforated burner plate 26 and the screen pack 27 are releasably secured in place over the discharge end of the nozzle body 18 by any suitable means, as by a retainer bushing 28 which is threadably mounted on the threaded inner end 25 of the nozzle body 18. The retainer bushing 28 has an inwardly extended annular flange that engages the outer periphery of the screen pack 27, and retains the screen pack 27 and the perforated burner plate 26 in place.

The numeral 29 generally designates a burner barrel or flame shield which functions as a primary combustion chamber. The burner barrel 29 is cylindrical in construction and is disposed with its open lower end telescopically mounted over the screen pack 27 on the nozzle body 18. The lower end of the burner barrel 29 is secured by a plurality of suitable screws 31 to a mounting ring 30 which is internally disposed in the lower end of the burner barrel 29. The mounting ring 30 is slidably mounted around the outer periphery fo the nozzle body 18, and it is fixedly secured thereto by any suitable means, as by welding. The upper end 33 of the burner barrel 29 is open, and it forms the discharge or outlet end of the burner barrel. The burner barrel 29 is provided with a circular sight opening 32 through the wall thereof, and it is aligned with a similar sight hole 34 formed through the wall of the body 10. A sight glass 35, made from a suitable heat resistant material, is fixedly mounted by any suitable means, over the outer end of the sight opening 34, on the outer surface of the body 10. The sight holes 32 and 34 and the sight glass 35 permit an operator to view the combustion action inside of the burner barrel 29.

As shown in FIG. 1, a spark plug, generally indicated by the numeral 36, is threadably mounted in a threaded bore 37 formed through the wall of the body 10 so as to maintain the spark plug in a position transverse to the longitudinal axis of the body 10 and the burner barrel 29. The spark plug 36 is provided with a pair of spark plug rods 38 and 39 which have their inner ends spaced apart by a suitable gap distance, and at a point spaced over the center line of the burner barrel 29 and upwardly therefrom.

The numeral 40 designates a threaded inlet port in which is threadably mounted one end of an inlet pipe or conduit means 41. The conduit means 41 is adapted to be connected to a suitable source of pressurized secondary air for supplying air under pressure into the lower end of the body 10. The pressurized secondary air flows upwardly around the nozzle body 18 and the burner barrel 29 for heating by the air and gas mixture flowing through said members, and combusted in the burner barrel 29.

The threaded port 40 is preferably disposed so as to bring the secondary air into the body 10 on a tangent disposition relative to the cylindrical interior surface of the chamber 11.

The body 10 is provided with a pressure relief safety means which includes an opening 42 formed through the lower end wall portion of the body 10. The safety opening 42 is normally enclosed by a pressure releasable safety cap 43. The safety cap 43 is retained in a position over the opening 42 to normally enclose the same by a suitable spring clamp 44, which has one end abutting the outer face of the cap 43 and the other end secured in place by a clamp 45, a washer 46 and bolts 47.

In use, the heater apparatus illustrated in FIG. 1 is operatively mounted on a packaging machine and disposed for heating the top end or bottom end of a plastic coated carton to activate the plastic on the carton prior to the closing and sealing of the carton end. The low noise burner of the present invention is adapted to heat workpieces such as a carton top end or bottom end in a packaging machine in a quiet and efficient manner. The air and fuel mixer unit 23 is connected to a suitable source of pressurized primary air and fuel, as an industrial gas under pressure. The air and gas are fed into the mixer 23 in desirable ratios for mixing the same, and under control of conventional flow control apparatus. The primary air and gas mixture flows upwardly through the pipe 22 and the reducer 21 and into the nozzle body 18, then it passes upwardly through fiberglass insulation wool packing 48, a perforated baffle 49 and through the perforated burner plate 26 and the screen pack 27. The primary air and gas mixture is ignited by the action of the spark plug 36 and after it is ignited, continuous combustion action takes place inside of the burner barrel 29. The perforated burner plate 26 functions to prevent flash back, and also to provide further mixture of the primary air and gas. The screen pack 27 also provides further flash back prevention and primary air and gas mixing functions. Secondary pressurized air is admitted through the inlet pipe 41 and passes upwardly around the hot burner barrel 29 and continues on in a heated and mixed state out through the cylindrical chamber 11 and the open discharge end 12 of the body 10, and into operative engagement with a plastic coated carton or other workpiece which is to be heated. The heated secondary air mixes with the combustion products in the chamber 11 portion above the burner barrel 29 before it exits through the discharge end 12 of the body 10. The employment of a separate air and fuel mixture for combustion purposes for heating a secondary air flow provides a heater which is quiet, and which eliminates harmful monoxide gases that heretofore have been generated by the prior art type heaters, and which gases formerly passed into the room in which the packaging machine was located, since such heaters are not provided with an exhaust vent or stack. The air and gas mixer 23 provides a proper air-fuel mixture for efficient burning of the same without producing harmful monoxide gases. The burner provides heated air at a low flow velocity, so as to produce a low noise level burner.

Figure 2:
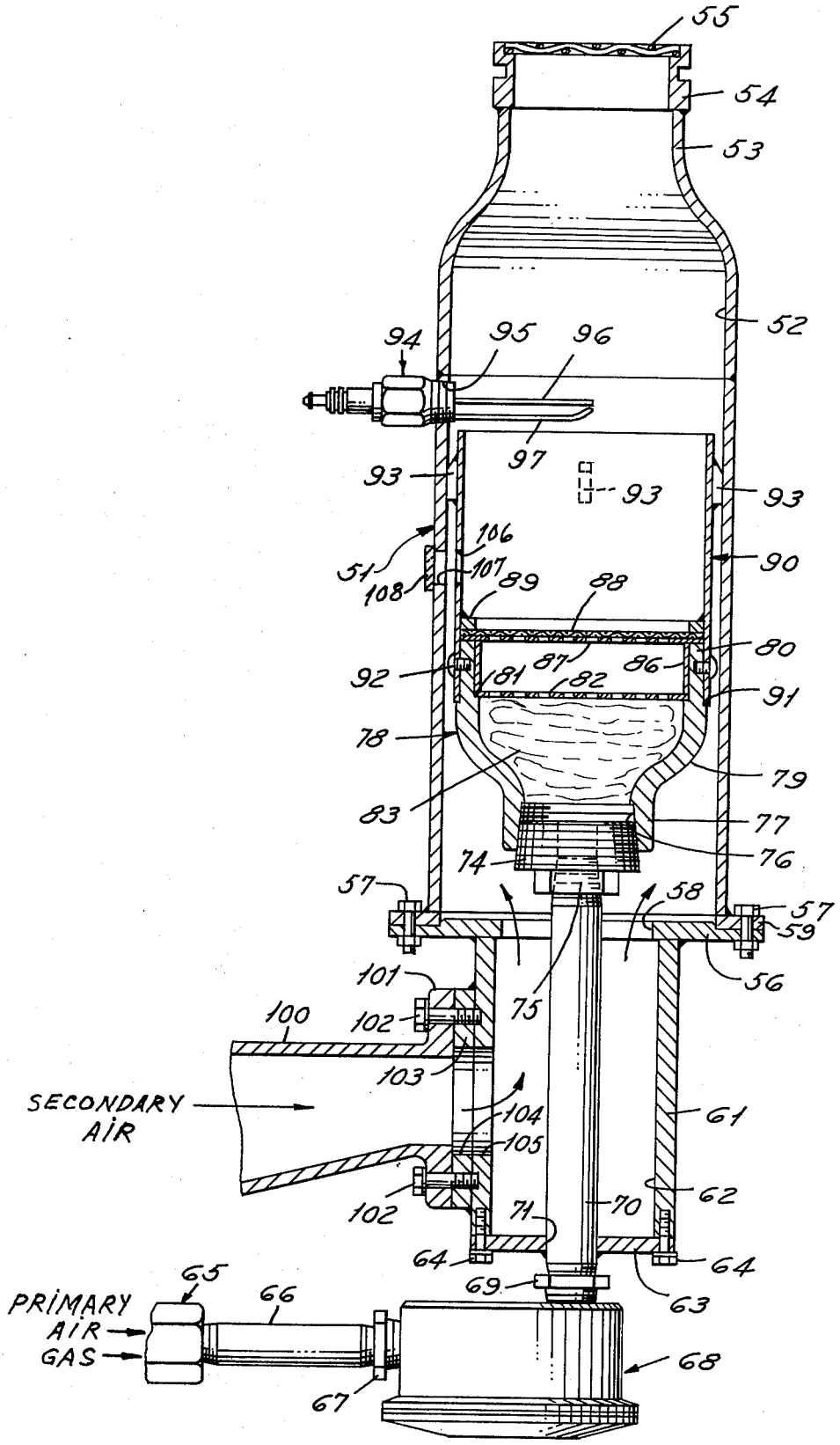
FIG. 2 is an elevational view, with parts in section, of a second embodiment of a high capacity quiet burner for a hot air heating system.

FIG. 2 illustrates a second illustrative embodiment of a high capacity quiet burner for a hot air heating system made in accordance with the principles of the present invention. The numeral 51 generally indicates the burner body, and it is cylindrical in overall configuration and includes an inner elongated, cylindrical chamber 52. The upper end 53 of the body 51 is reduced in diameter, so as to provide a contracting effect to the mixture of the heated secondary air and combustion gases flowing therethrough, for increasing the flow velocity thereof. An annular mounting collar 54 is fixedly mounted on the upper end of the burner body 51. A coarse, heavy mixing screen 55 is fixedly mounted, as by welding, on the outer open end of the collar 54, for improving the mixing of the heated secondary air and combustion gases.

The lower end of the burner body 51 is enclosed by a mounting plate 56 which is secured by a plurality of bolt and nut assemblies 57 to an annular flange 59 that is fixedly mounted, as by welding, on the lower end of the burner body 51. An opening 58 is formed through the mounting plate 56 for communicating the lower end of the burner body 51 with the interior or chamber 62 of a cylindrical secondary air inlet housing 61. The upper end of the housing 61 is fixedly secured, as by welding, to the outer face of the mounting plate 56. The lower end of the inlet housing 61 is enclosed by a closure plate 63 which is secured to the housing 61 by suitable machine screws 64.

As shown in FIG. 2, the numeral 65 generally indicates a conventional primary air and fuel mixer which is adapted to be connected to a suitable source of pressurized primary air and fuel, as for example, a source of industrial gas under pressure, and a suitable air blower or compressed air unit. A pipe 66 has one end thereof threadably connected to the air and fuel mixer 65, and the other end thereof threadably mounted in a reducer bushing 67. The reducer bushing 67 is threadably mounted in the inlet of a conventional primary air and gas filter assembly, generally indicated by the numeral 68. A reducer bushing 69 is threadably mounted in the outlet end of said filter assembly 68. One end of an air-fuel feed pipe 70 is threadably mounted in the reducer bushing 69, and said end of the pipe 70 passes through a hole 71 formed through the closure plate 63, and it is fixed to the plate 63 by welding.

The other end of the pipe 70 is threadably mounted in a suitable pipe fitting 75, which in turn is threadably mounted in a reducer bushing 74. The reducer bushing 74 is threadably mounted in the threaded lower end 76 of the body 79 of a burner nozzle, generally indicated by the numeral 78. The upper end 80 of the nozzle body 79 is formed to an enlarged diameter, as compared to the lower reduced diameter end 77. The upper end 80 of the nozzle body 79 is connected to said lower reduced diameter end 77 by a gradually enlarged and curved portion, so as to reduce the flow velocity of the air and gas mixture from the outlet of the pipe 70 through the nozzle body 79 to reduce fluid flow noise.

The chamber inside of the upper end 80 of the nozzle body 79 is recessed, or made to an enlarged diameter, so as to provide a shoulder 81 on which is seated a transverse, annular, perforated baffle 82. A cylindrical or sleeve retainer 86 is seated within the nozzle body upper end portion 80, and it has its lower end seated on the top of the perforated baffle plate 82 around the periphery thereof for retaining said baffle plate 82 in place. A second perforated burner plate 87 is seated over the upper end of the nozzle body portion 80 and it engages the outer end of the retainer sleeve 86 for holding it in place. A screen pack 88 is seated on top of the perforated burner plate 87. The screen pack 88 comprises one or more layers of screen material made from a suitable heat resistant material. For optimum operation, this screen pack 88 should be made from screen that is not coarser than a thirty mesh screen and not finer than a forty mesh screen. The chamber inside of the nozzle body 79, between the inner perforated baffle plate 82 and the reducer bushing 74 is preferably filled with a fiberglass packing 83 which may comprise any suitable packing of this type, as for example, fiberglass insulation wool used in insulating buildings.

The numeral 90 generally designates a burner barrel or flame shield which functions as a primary combustion chamber. The burner barrel 90 is cylindrical in construction and it is disposed with its open lower end telescopically mounted around the large diameter end 80 of the nozzle body 79. The burner barrel 90 has its lower end seated on a shoulder 91 formed around the outer periphery of the nozzle body portion, and it is secured thereto by a plurality of suitable screws 92. A retainer ring 89 is mounted around the inside of the burner barrel 90, and it is seated around the outer periphery of the screen pack 88 for retaining it and the outer perforated plate or baffle 87 in place. The retainer ring 89 is fixed to the burner barrel 90 by any suitable means, as by welding. A plurality of mounting brackets 93 are fixed, as by welding, in equally spaced positions around the outer periphery of the burner barrel 90, and they are adapted to have their outer faces in slidable contact with the inner surface of the chamber 52 formed in the burner body 51.

As shown in FIG. 2, a spark plug, generally indicated by the numeral 94, is threadably mounted in a suitable bore 95 formed through the wall of the body 51, so as to maintain the spark plug in a position transverse to the longitudinal axis of the body 51 and the burner barrel 90. The spark plug 94 is provided with a pair of spark plug rods 96 and 97 which have their inner ends spaced apart by a suitable gap, and at a point spaced over the center line of the burner barrel 90, and upwardly therefrom.

The numeral 100 designates an inlet pipe or conduit means which is adapted to be connected to a suitable source of pressurized secondary air for supplying air under pressure into the secondary air housing 61. The secondary air inlet supply pipe 100 is supplied with an integral flange 101 which is fixedly secured by a plurality of suitable machine screws 102 to a mounting plate 103. The mounting plate 103 is also secured to the housing 61 by the screws 102. The inlet or supply pipe 100 communicates with the interior of the housing 61 through an opening 104, formed through the mounting plate 103, and an opening 105 formed through the wall of the housing 61.

The burner barrel 90 is provided with a circular sight opening 106 formed through the side wall thereof, and it is aligned with a similar sight opening 107 formed through the wall of the burner body 51. A sight glass 108, made from a suitable heat resistant material, is fixedly mounted by any suitable means, over the outer side of the sight opening 107, on the outer surface of the body 51. The sight holes 106 and 107, and the sight glass 108, permit an operator to view the combustion action inside of the burner barrel 90.

In use, the heater apparatus as illustrated in FIG. 2 is operatively mounted on a packaging machine, and it is disposed for either heating the top end or the bottom end of the plastic coated carton to activate the plastic on the carton prior to the closing and sealing of the carton end. It will be understood that a plurality of these heaters may be disposed for heating the bottom ends of a plurality of cartons, and a plurality of such heaters may be used for heating the top ends of a plurality of cartons during a packaging operation. The air and fuel mixer unit 65 is connected to a suitable source of pressurized primary air and fuel, as for example, a suitable blower or air compressor unit and a source of industrial gas under pressure. The air and gas are fed into the mixer 65 in desired ratios for mixing the same, and under the control of suitable conventional flow control apparatus.

The primary air and gas mixture flows through the filter 68, which may be of any suitable type, as for example, one including a cellulose type of filter material. The filter 68 provides some filtering of adverse materials out of the air and gas mixture. Its primary purpose is to limit fluid flow noises. The mixture of air and gas passes upwardly from the filter 68 through the pipe 70 and into the nozzle 78. The flow of the air and gas mixture is slowed as it passes up through the nozzle body 79, due to the gradually enlarging diameter of the inner chamber in the nozzle body 79. The fiberglass packing 83 also functions as a noise filter for absorbing noises created by the flow of the air and gas mixture into and through the nozzle 78. The primary air and gas mixture flows through the lower perforated plate 82 and the upper perforated plate 87, and through the screen pack 88, and into the burner barrel 90 where it is ignited by the spark plug 94. After the air and gas mixture has been started, a continuous combustion action takes place inside of the burner barrel 90. The perforated plates 82 and 87 function as baffles to provide further mixing of the primary air and gas, and also to prevent flash backs of flame from the burner barrel 90. The screen pack 88 also provides further flash back prevention and primary air and gas mixing functions.

The secondary pressurized air is admitted through the inlet pipe 100 and passes into the inlet housing 61 and thence upwardly through the opening 58 and into the burner body 51. The secondary air passes upwardly around the nozzle 78 and the burner barrel 90, and it is heated and continues on in a heated state out through the chamber 52 in the burner body 51. The heated secondary air is mixed with the combustion gases or products in the chamber 52 in the area above the burner barrel 90, and they are further mixed together as they pass out of the burner body 51 through the screen 55. The reduced diameter upper end portion 53 of the burner body 51 reduces the diameter cross section area of the flow path for the mixture of heated secondary air and combustion gases so as to increase the fluid flow velocity of the same. The mixture of heated secondary air and combustion gases is passed through the mixing screen 55 and into operative engagement with the plastic coated carton or other workpiece which is to be heated.

It will be seen that the screen packs 27 and 88 in the two described embodiments assist in mixing and dividing the primary air and gas mixture into fine segments which results in uniform and stable combustion. The perforated plates 26, 87 and 82 also function to assist in mixing the primary air and gas so as to provide turbulent flow and mixing flow of the same, which also assists in uniform and stable combustion. The screen packs 27 and 88 also assist in providing a lower noise level of combustion because the gas mixture is broken up so as to provide fine flames with less noise. The uniform and stable combustion provided by the burner of the present invention is also a more efficient combustion so as to eliminate injurious monoxide gases. The fiberglass pack 83 of the second embodiment illustrated in FIG. 2 further assists in reducing the noise level, since it provides a further dividing of the gas mixture into fine segments as said mixture passes through the fiberglass pack, and it eliminates flow noises and vibrations which are inherent in high capacity fluid flow mixtures of this type. It will also be seen that the configuration of the burner nozzle 78 slows the fluid flow velocity down as the primary air and gas mixture moves upward to the combustion area to eliminate fluid flow noise. After combustion has taken place, and the mixture of the secondary air and combustion gases has occurred above the heat shield 90 in the embodiment of FIG. 2, the heated air and gases are again contracted by the particular shape of the outlet end of the burner body 51 so as to then increase the velocity of the fluid flow of the heated air and combustion gases passing through the screen 55.

In one embodiment of the structure shown in FIG. 2 having a high capacity of up to 130,000 B.T.U., the inner diameter of the flame shield 90 was 4½ inches, the inner diameter of the upper end portion of the nozzle body was 4 inches, and the perforated plates 87 and 82 were spaced apart about 1 inch. The inner diameter of the burner body 51 was 5 inches in the area around the burner nozzle 78 and heat shield 90. The primary air and gas mixture was admitted to the burner nozzle 78 by a ¾ inch pipe, and the entrance end of the burner nozzle body was reduced to an inner diameter of about 2½ inches. The outlet end of the burner body 51 was reduced to a diameter of approximately 2-¾ inches.

It will be understood that all the various parts of the two embodiments are made from suitable heat resistant metals.

While it will be apparent that the preferred embodiments of the invention herein disclosed are well calculated to fulfill the objects above stated, it will be appreciated that the invention is susceptible to modification, variation and change.

What is claimed is:

1. A burner for a hot air heating system comprising:

(a) a tubular burner body having a chamber therein which is open at an outlet end and enclosed at an inlet end;

(b) a burner nozzle means mounted in said burner body chamber adjacent the inlet end thereof, and having a tubular combustion chamber with an axial outlet end in the burner body and an axial inlet end, a screen means over the outlet of said burner nozzle and a perforated plate spaced upstream of said screen, said tubular combustion chamber mounted about the outlet of said nozzle means;

(c) means for conveying a prior mixed, mixture of primary air and fuel axially into said burner nozzle means at the inlet end thereof.

(d) means for igniting said mixture of primary air and fuel in said burner; and, (e) a source of our above atmosphere pressure and means connected to said source for conveying secondary air under pressure into said burner body chamber for flow of all the secondary air around said burner nozzle and tubular combustion chamber and axially past the outlet end of the burner nozzle means and tubular combustion chamber for heating said secondary air, and through said burner body chamber for mixing with the combustion gases formed by the combustion of said prior mixed, mixture of primary air and fuel in said tubular combustion chamber, and for subsequent discharge through the outlet end of said burner body chamber onto an object for heating the same.

2. A burner for a hot air heating system as defined in claim 1, wherein:

(a) said means for conveying secondary air into said burner body is arranged to admit said secondary air into said burner body on a tangent relative to the periphery of said burner nozzle body.

3. A burner for a hot air heating system as defined in claim 1, wherein:

(a) said means for conveying secondary air into said burner body chamber is arranged to admit said secondary air into said burner body chamber at a point below the burner nozzle body inlet end.

4. A burner for a hot air heating system as defined in claim 1, wherein:

(a) said means for conveying a mixture of primary air and fuel into said nozzle body includes a filter means for filtering the prior mixed, mixture of primary air and fuel.

5. A burner for a hot air heating system as defined in claim 1, wherein:

(a) said means for conveying secondary air into said burner body chamber is arranged to admit said secondary air into said burner body chamber at a point below the burner nozzle body inlet end; and, (b) said means for conveying a mixture of primary air and fuel into said nozzle body includes a filter means for filtering the mixture of primary air and fuel.

6. A burner for a hot air heating system as defined in claim 1, wherein:

(a) said burner body is provided with sight hole means and sight glass means; and, (b) said tubular combustion chamber is provided with sight hole means, whereby the combustion action in the tubular combustion chamber may be viewed by an operator through said sight glass and said sight hole means.

7. A burner for a hot air heating system as defined in claim 1, wherein:

(a) said burner body is provided with a pressure releasable safety cap.

8. A burner for a hot air heating system as defined in claim 1, including:

(a) a perforated plate mounted in said burner nozzle body adjacent the inner side of said screen means.

9. A burner for a hot air heating system as defined in claim 1, wherein:

(a) said burner nozzle body has mounted therein a fiberglass filter means.

10. A burner for a hot air heating system as defined in claim 9, including:

(a) a first perforated plate mounted in said burner nozzle body adjacent the inner side of said screen means.

11. A burner for a hot air heating system as defined in claim 1, wherein:

(a) a screen means is mounted over the outlet end of said burner body chamber.

12. A burner for a hot air heating system as defined in claim 1, wherein:

(a) the outlet end of said burner body chamber has a reduced diameter cross-sectional area as compared to the cross-sectional area of said burner body chamber at the point in said chamber where said burner nozzle means is located.

13. A burner for a hot air heating system as defined in claim 1, wherein:

(a) the inlet end of said burner nozzle body is made to a reduced diameter cross-sectional area as compared to the outlet end of said burner nozzle body.

14. A burner for a hot air heating system comprising:

(a) a tubular burner body having a chamber therein which is open at an outlet end and enclosed at an inlet end;

(b) a burner nozzle means mounted in said burner body chamber adjacent the inlet end thereof; , and a tubular combustion chamber mounted about the discharge end of said nozzle means (c) means for conveying a mixture of primary air and fuel into said burner nozzle means;

(d) means for igniting said mixture of primary air and fuel in said burner;

(e) means for conveying secondary air under pressure into said burner body chamber for flow around said burner nozzle and tubular combustion chamber for heating said secondary air, and through said burner body chamber for mixing with the combustion gases formed by the combustion of said mixture of primary air and fuel in said burner, and for subsequent discharge through the outlet end of said burner body chamber onto an object for heating the same;

(f) said burner nozzle means including an elongated tubular body having an inlet end connected to said means for conveying a mixture of primary air and fuel into said nozzle body;

(g) said burner nozzle body being provided with a screen means over the outlet end of said burner nozzle body;

(h) said burner nozzle body having mounted therein a fiberglass filter means;

(i) a first perforated plate mounted in said burner nozzle body adjacent the inner side of said screen means; and, (j) a second perforated plate mounted in said burner nozzle body between said fiberglass filter means and said first perforated plate, and being spaced apart from said first perforated plate.

15. A burner for a hot air heating system as defined in claim 14, including:

(a) a screen means mounted over the outlet end of said burner body chamber.

16. A burner for a hot air heating system as defined in claim 14, wherein:

(a) the outlet end of said burner body chamber has a reduced diameter cross-sectional area compared to the cross-sectional area of said burner body chamber at the point in said chamber where said burner nozzle means is located.

17. A burner for a hot air heating system as defined in claim 14, wherein:

(a) the inlet end of said burner nozzle body is made to a reduced diameter cross-sectional area compared to the outlet end of said burner nozzle body.

18. A burner for a hot air heating system as defined in claim 14, wherein:

(a) a screen means is mounted over the outlet end of said burner body chamber;

(b) the outlet end of said burner body chamber has a reduced diameter cross-sectional area compared to the cross-sectional area of said burner body chamber at the point in said chamber where said burner nozzle means is located; and, (c) the inlet end of said burner nozzle body is made to a reduced diameter cross-sectional area as compared to the outlet end of said burner nozzle body.

* * * * *

UNITED STATES PATENT OFFICE

CERTIFICATE OF CORRECTION

Patent No. 4,082,497 Dated April 4, 1978

Inventor(s) CRAWFORD et al

It is certified that error appears in the above-identified patent and that said Letters Patent are hereby corrected as shown below:

Column 8, line 66, delete "our" and insert ---air---.

Signed and Sealed this

*Twelfth* Day of *September 1978*

[SEAL]

*Attest:*

RUTH C. MASON
*Attesting Officer*

DONALD W. BANNER
*Commissioner of Patents and Trademarks*